US005630958A

United States Patent [19]

Stewart, Jr. et al.

[11] Patent Number: 5,630,958

[45] Date of Patent: May 20, 1997

[54] SIDE ENTRY COIL INDUCTION HEATER WITH FLUX CONCENTRATOR

[76] Inventors: John B. Stewart, Jr., 1533 Meadow La., Burlingame, Calif. 94010; Peter M. Godfrey, 32328 Pollux Ct., Union City, Calif. 94587; Philippe F. Levy, 2703 Sequoia Way, Belmont, Calif. 94002

[21] Appl. No.: 379,408

[22] Filed: Jan. 27, 1995

[51] Int. Cl.[6] ..... H05B 6/40

[52] U.S. Cl. ..... 219/670; 219/672; 219/674; 219/637

[58] Field of Search ..... 219/670, 672, 219/673, 674, 637, 643, 613, 634

[56] References Cited

U.S. PATENT DOCUMENTS

| | | | |
|---|---|---|---|
| 3,397,295 | 8/1968 | Hale | 219/670 |
| 3,725,629 | 4/1973 | Vickers | 219/674 |
| 3,842,234 | 10/1974 | Seyfried | 219/673 |
| 4,100,387 | 7/1978 | Reinke | 219/673 |
| 4,363,946 | 12/1982 | Busemann | 219/10.59 |
| 4,549,057 | 10/1985 | Anderson | 219/10.79 |
| 4,694,134 | 9/1987 | Ross | 219/670 |
| 4,857,687 | 8/1989 | Andersson et al. | 219/673 |
| 5,208,443 | 5/1993 | McGaffigan | 219/505 |
| 5,231,267 | 7/1993 | McGaffigan | 219/10.41 |
| 5,317,121 | 5/1994 | Katayama et al. | 219/672 |

FOREIGN PATENT DOCUMENTS

| | | |
|---|---|---|
| 133285 | 8/1971 | Denmark . |
| 0212490 | 3/1987 | European Pat. Off. . |
| 0244580 | 11/1987 | European Pat. Off. . |
| 0589087 | 3/1994 | European Pat. Off. . |
| 1030775 | 6/1953 | France . |
| 47-18743 | 9/1972 | Japan . |
| 1011705 | 4/1983 | U.S.S.R. . |
| WO92/15182 | 9/1992 | WIPO . |

*Primary Examiner*—Philip H. Leung

*Attorney, Agent, or Firm*—Herbert G. Burkard; Sheri M. Novack

[57] ABSTRACT

An induction heater for heating a portion of a load comprises a side entry coil driven by a source of alternating current, with a flux concentrator located at the coil opening. The coil produces a magnetic field in the region occupied by the flux concentrator and the heated portion of the load. The flux concentrator extends along the opening of the coil and is fabricated of high permeability, low loss material, such as nickel-zinc ferrite, so as to enhance the uniformity of the magnetic field generated within the coil. In the preferred application, heating produces a complete fluid block in a cable section within the coil without overheating or damaging the cable.

19 Claims, 3 Drawing Sheets

SIDE ENTRY COIL INDUCTION HEATER WITH FLUX CONCENTRATOR

BACKGROUND OF THE INVENTION

This invention pertains generally to the field of induction heating devices, particularly, to side entry coil induction heaters that are used to heat a load, and more particularly are used to form blocks in wire harness and cable assemblies.

In fabricating cables and harnesses containing a plurality of wires it is desirable to provide fluid blocks to prevent the passage of fluids, such as water, along the cable. This problem arises in various industrial and commercial applications where cables are used, such as the automotive and telecommunications fields. In cable assemblies used in automobiles, for example, it is important to prevent moisture from migrating along the wires in the cable to various electrical components in different parts of the car. It is also desirable to avoid the passage of fumes and noise through the cable from the engine compartment to the passenger area.

Various techniques have been employed to deal with this problem. In the automotive field, wire harness assemblies are sometimes arranged with "drip loops", which consist of U-sections of the wires hanging down so that water passing along the wires will drip off at the bottom of the U-section. Obviously this is only a partial solution to the problem.

A desirable technique is to provide a packing or sealant around the wires in a protective sleeve, which is designed to form a complete fluid block. This technique is described in detail in U.S. Pat. No. 4,972,042 ("Blocking Arrangement for Suppressing Fluid Transmission in Cables"), issued to Seabourne et al. on Nov. 20, 1990, assigned to the same assignee as the present application and incorporated herein by reference. This patent discloses the use of fusible polymeric sealants, such as hot-melt adhesives or thermosetting adhesives, in a heat-shrinkable covering or sleeve surrounding the cable wires. The application of heat to this assembly causes the adhesive to melt and surround the wires, forming a block upon cooling. Epoxy sealants may also be utilized, in which the application of heat facilitates curing and formation of a permanent fluid block in the cable.

This technique requires the application of heat to the assembly in a controlled manner, to provide a satisfactory blocking structure. Both the temperature of the assembly and the heating time must be carefully monitored. Excessive temperatures can cause damage to the cable wires or insulation, as well as the protective covering and sealant. On the other hand, if the heating temperature is too low, the blocking seal may not form completely and the block will be ineffective to prevent fluid passage. Ideally the heating should be uniform throughout the cable block to avoid hot spots and cold spots in the sealant.

Induction heating is a widely used heating method for applications requiring precise heating control. Although originally this method was developed primarily for heating metals, it has also been used for other materials. For example, U.S. Pat. No. 5,378,879, entitled "Induction Heating of Loaded Materials", issued on Jan. 3, 1995 to Y. Monovoukas, which is assigned to the same assignee as the present application and incorporated herein by reference, describes the induction heating of non-magnetic, electrically non-conductive materials by means of loading with suitable particles. As disclosed in that application, this technique may be used in the fabrication of sealant blocks in wire cable and harness assemblies.

Ideally, a simple induction coil of the usual solenoidal configuration would provide a uniform magnetic field and, therefore, uniform heating of the sealant, if the cable were disposed along the axis of the coil. However, this configuration is not suitable for normal manufacturing operations because it requires that the cable be threaded through the coil, which is a serious fabrication constraint. For practical purposes, the induction coil must have a shape that allows the coil to be brought close to the cable from the side, or laterally, at the location along its length where heating is desired without having to thread the cable through the coil.

Induction coils that provide such lateral access to the heating area have been designed with a variety of configurations and may be broadly described as side entry coil assemblies. One example of a side entry coil assembly is a U-shaped coil. Another example is actually constitutes two flat coils (or "pancake coils") located on opposite sides of the heating area, with the planes of these coils in parallel alignment. The currents in both coils circulate preferably in the same direction, to optimize the magnetic induction in the heating area.

For heating loads of elongated shape, such as cables, a particularly suitable side entry assembly configuration is the "channel coil" (or "U-channel coil"). A channel coil configuration may be obtained by taking a flat coil and deforming the plane of the coil into a "U-shape" about an axis that is parallel to the plane of the coil. Such a coil allows lateral access to the cable assembly, in that it forms a channel along which the cable can be laid through the opening in the "U". An important characteristic of this type of configuration is that in the central region along the channel, the magnetic field direction in the channel interior and mouth of the "U" is primarily transverse; that is, the direction is perpendicular to the channel axis.

Obviously, this type of channel coil does not have the degree of cylindrical symmetry provided by a solenoidal coil, and generally the magnetic field produced by a channel coil is highly non-uniform in the channel. Even if the field strength is relatively constant along the longitudinal dimension in the heated portion of the cable, unless the transverse dimensions of the cable are inordinately small, this implies that the magnetic field and the induction heating produced by the coil will not be uniform across the cable. This problem has been encountered in using channel coils to fabricate cable blocks using induction heating. The magnetic field is generally stronger near the base of the channel, and weaker near the opening of the "U". It has been found that when channel induction heating coils are used in this way, hot spots tend to form in the side of the cable near the U-base, while cold spots form near the opening of the "U". The unevenness of the heating is often manifested by lumps and voids in the sealant, and damaged insulation around the wires. In some samples, some of the wires near the U-base are found to become overheated and damaged, while in the same sample the sealant near the opening of the "U" fails to heat sufficiently to form a complete seal.

SUMMARY OF THE INVENTION

The present invention provides an induction heater for heating a load in which the magnetic induction field and heating of the material are sufficiently uniform to produce the desired results. In a preferred application, the present invention provides an induction heater for forming a fluid block in a cable assembly or bundle in which the magnetic induction field and heating of the sealant are sufficiently uniform to produce a complete fluid block without causing overheating or damage to any part of the cable assembly. The induction heating coil is preferably a side entry coil into which the portion of the load to be heated may be laterally inserted. Particularly near the mouth or mouths of the side entry coil assembly, coils or coil assemblies appropriate for this invention generate a magnetic field that is substantially transverse along this portion of the load; that is, the field direction is primarily perpendicular to the longitudinal opening axis at the portion of the load near the mouth.

A flux concentrator is provided at the mouth or opening of the side entry coil assembly. This flux concentrator is an elongated structure which extends along the coil opening and spans the heated part of the load. The concentrator increases the magnetic flux at the opening, relative to the flux at the opening if the concentrator were absent. The resulting magnetic flux in the heated portion of the load provides uniform heating without overheating or damaging any part of the load. The magnetic field produced by the flux concentrator in the load near the mouth is increased, so that the heating efficiency is improved and the heat treatment time is lowered.

The flux concentrator is made preferably of a ferrite material. This material is selected to have a high magnetic permeability and low loss at the induction heating frequency. The dimensions and placement of the flux concentrator are chosen to optimize the magnetic flux concentration effect and avoid overheating of the concentrator itself.

It is an object of the invention to provide a device for uniformly heating a load, without causing overheating or damage to the load.

A second object of this invention is to provide a device for heating a load, in which the heating efficiency is improved and the heat treatment time is decreased.

Another object of this invention is to provide a device for heating a load, in which the heating time and temperature are controlled in the region of the load.

Yet another object of the invention is to provide a magnetic induction heating structure for heating a load, in which the induction coil has lateral access to the load so that the load may be heated without threading it through the coil.

These and other objects, advantages, characteristics and features of this invention may be better understood by examining the following drawings together with the detailed description of the preferred embodiments.

BRIEF DESCRIPTION OF THE DRAWINGS

FIG. 2 also shows the load inside the heating structure.

DETAILED DESCRIPTION OF THE PREFERRED EMBODIMENTS

Figure 1:
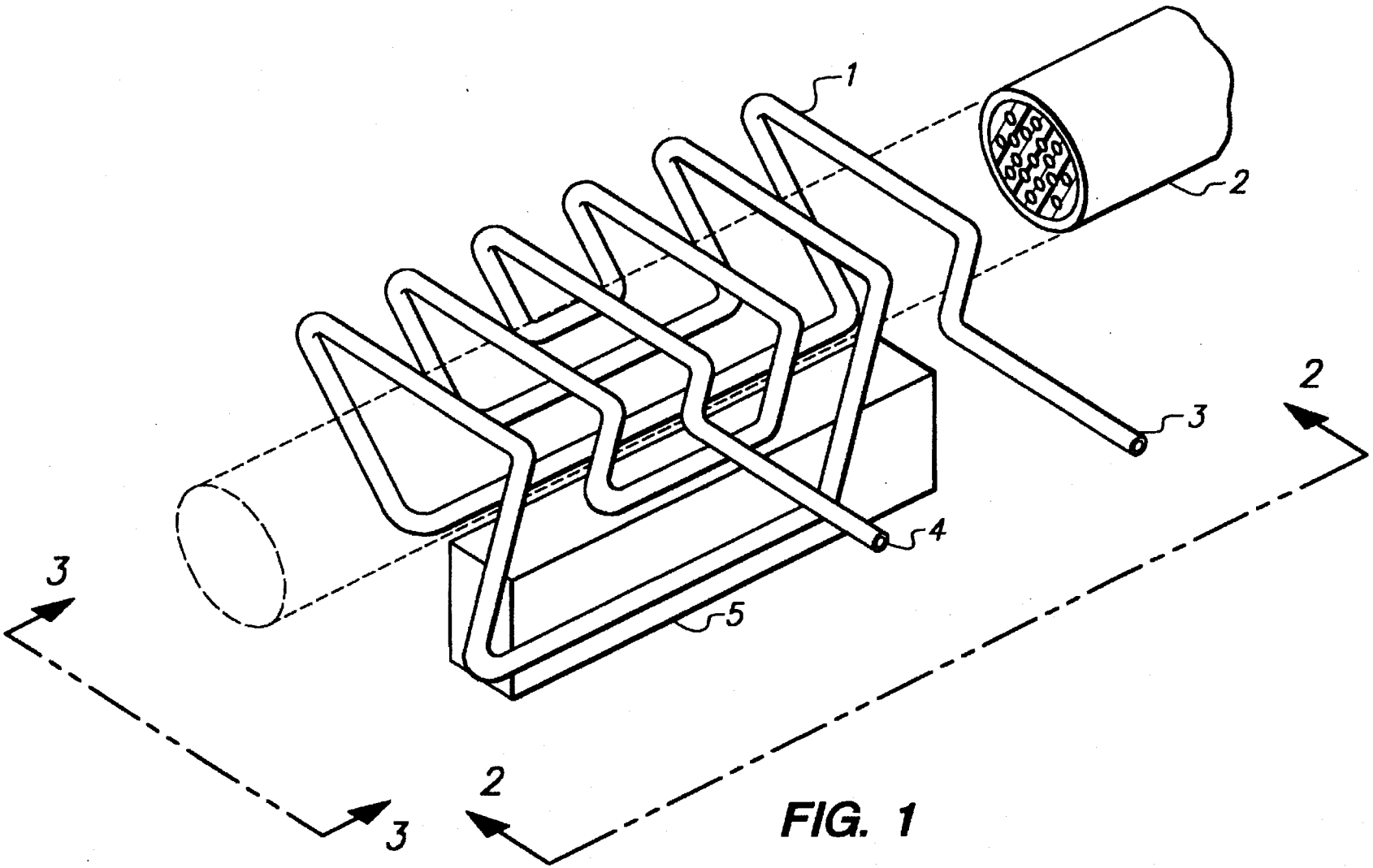
FIG. 1 shows a perspective view of a magnetic induction heating structure for heating a load, according to the present invention. The load is also shown schematically in this Figure by dotted lines extending through the heating structure, and by a sectional view of part of the load extending outside the heating structure.
Figure 3:
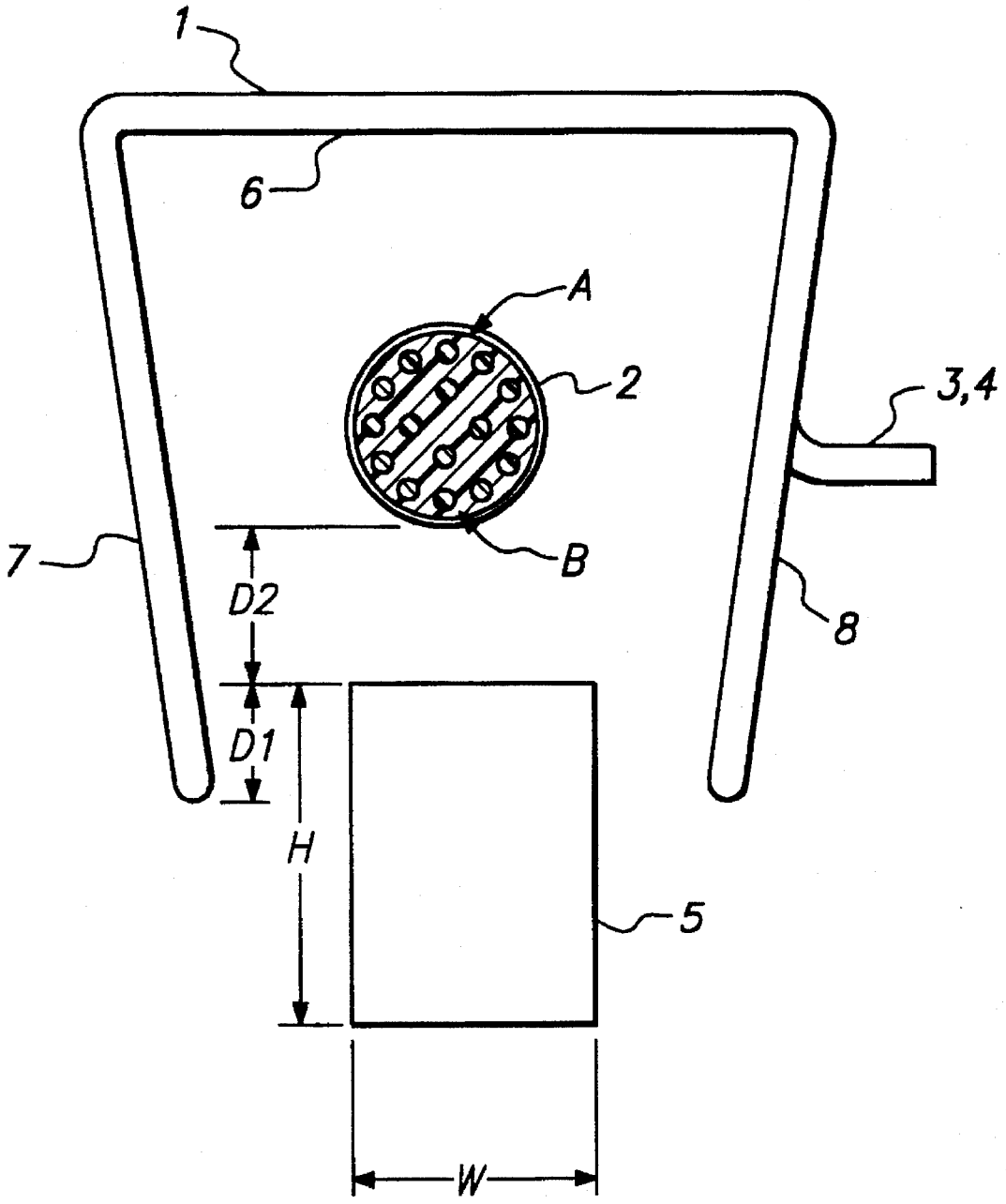
FIG. 3 is an end view of the heating structure of FIG. 1, looking in the direction 3—3 shown in FIG. 1, showing also a cross section of the load in the structure as in FIG. 2.

FIG. 1 shows the induction heating structure of the present invention for heating a load constructed according to the present invention. An induction coil 1 may be any side entry coil carrying a high frequency electric current that generates the magnetic induction field. The coil is driven by a power supply connected to coil ends 3, 4 shown in FIG. 1. This power supply is omitted from the drawing for simplicity. Viewed from one end, as shown in FIG. 3, the coil profile of the present embodiment is a side entry coil having an opening in one side of the coil, such that a load 2 may be laterally inserted into the opening. The portion of load 2 to be heated is thus positioned inside coil 1. From FIG. 1 it is clear that the load can be placed in this opening laterally, without threading, cutting or disconnecting the load at any point.

In one form of the invention, the side entry coil may be regarded generally as a deformation of a planar coil. If one views a planar coil from the edge in a direction parallel to the plane, and deforms the coil plane by bending or folding the sides about axes parallel to the plane so that the plane becomes a "U" shape viewed from the edge, the coil then has the configuration of a channel coil, where the channel is defined by this "U-shape". FIG. 3 shows this "U" shape of the coil clearly; in the orientation illustrated in this Figure the opening formed by the coil is actually an inverted "U". The base of the "U" is defined by upper section 6 of the coil, while the sides of the "U" are formed by lateral sections 7, 8 of the coil.

Channel coils of this type have been previously used for induction heating applications where it is desirable to provide a channel region for the objects being heated. Single-turn channel coils (sometimes termed "baseball seam coils") have also been designed for other applications. In the present structure the channel coil is a multiturn coil, which may be viewed as a flat "pancake" coil that has been deformed so that the plane of the pancake forms a "U" channel. For simplicity of illustration, the particular coil illustrated in the drawings is deformed from a rectangular pancake shape; however, other side entry configurations may be used.

Figure 2:
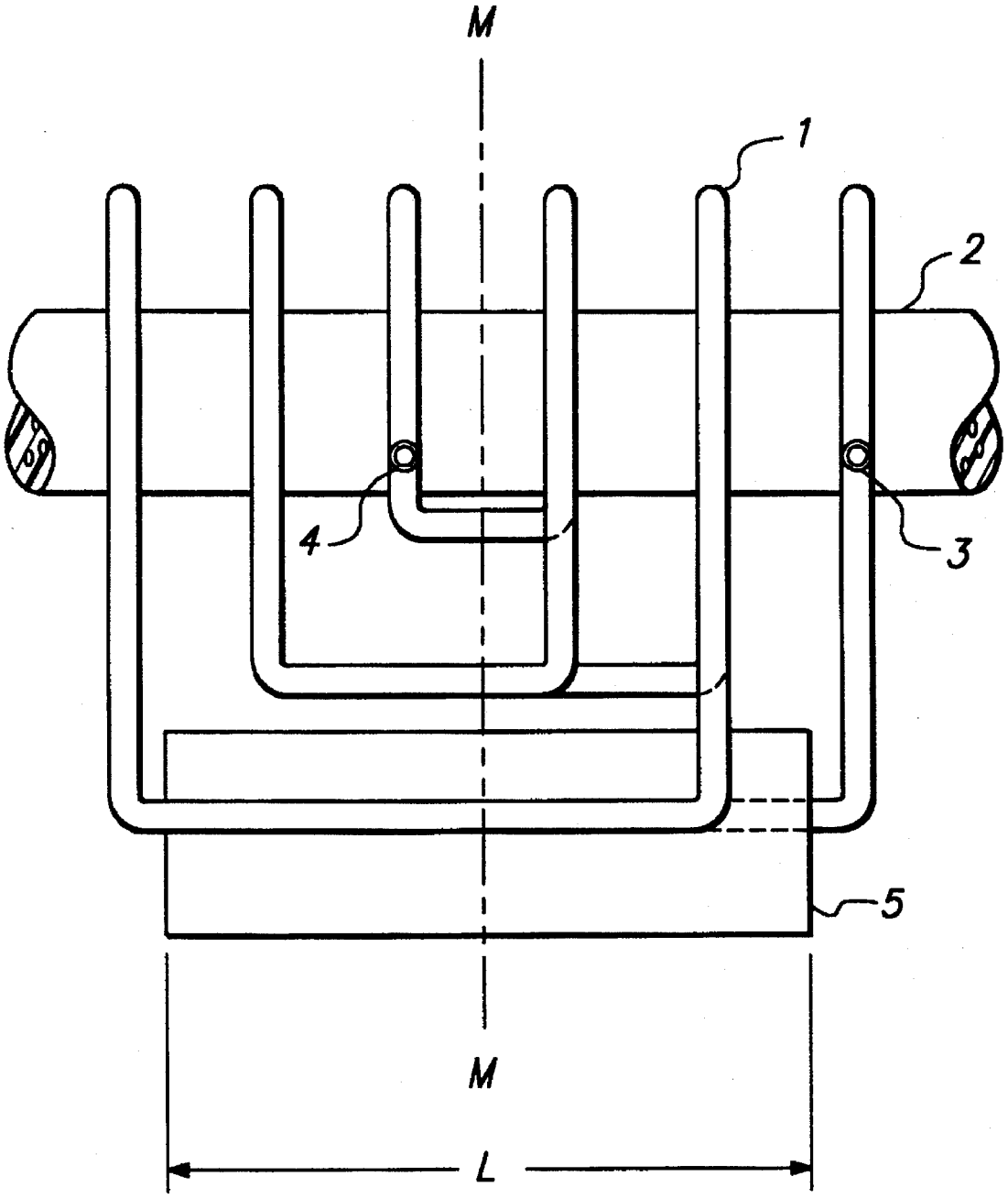
FIG. 2 shows a side view of the heating structure of FIG. 1, viewed in the direction 2—2 indicated in FIG. 1, perpendicular to the load axis.

The side entry coil shown in the drawings produces a magnetic field having a direction that is substantially transverse to the longitudinal axis of the opening within a region defined by a planar slab orthogonal to this axis passing through the center of the coil. This may be understood more clearly by referring to FIG. 2, in which a central plane is defined by "M—M", perpendicular to the axis of the opening and passing through the center of the coil. If the coil conductors were perfectly symmetrical about this plane, and if we were to neglect the coil lead conductors and other asymmetrical features of the configuration, then the symmetry of the structure would produce a magnetic field that would be entirely transverse at every point in the plane M—M. Of course such a symmetry is idealized, and any real coil will produce magnetic fields having some solenoidal components. The side entry coils utilized in the present invention generate magnetic fields that are substantially transverse in some region about this central plane. Such fields may be produced by deformed planar coils, as described above, that are primarily symmetrical about the central plane. This transverse field region encompasses the heated region of the load.

It will be appreciated by persons reasonably skilled in the relevant art that normally the magnetic field generated by a side entry coil attains its maximum strength in the region of base 6 of the coil. In the orientation shown in the drawings this region is at the top of the structure. The field becomes weaker as one proceeds toward the opening of the coil (i.e. downward in the orientation shown in the drawings). When the load is located inside the coil as illustrated in the drawings, the field that would be produced by the coil alone would be stronger in the upper part of the load and weaker in the lower part. This variation of the field strength and orientation gives rise to the nonuniformity of heating with side entry induction coils alone.

Referring again to the Figures, the present device provides a flux concentrator 5, which is an elongated member disposed at the opening of the side entry coil and extending along the opening over a span that encompasses the region of the load to be heated. This member is preferably fabricated from ferrite material, so that it has a high magnetic permeability, but may be constructed of any material having the desired properties to be described below. Flux concentrator 5 is located within the transverse field region of the opening of the side entry coil so as to provide a substantially uniform magnetic field. The effect of the flux concentrator is to increase the magnitude of the magnetic field in the region of the coil opening and the heated portion of the load. This increase is designed to offset the variation of the field strength near the opening of the coil that would be produced by the side entry coil without the flux concentrator, and results in a substantially constant heating rate in the load. The increase in this field strength produced by the flux concentrator also improves the efficiency of the heating process.

It will be recognized by persons of ordinary skill in the art that the above-described flux enhancement effects are obtained only for magnetic fields that are transverse to the axis of the side entry coil. If the magnetic field produced by the coil were substantially longitudinal, the insertion of flux concentrator member 5 would tend to decrease the field in the portion of the load nearest to the member, which would degrade the uniformity and efficiency of the induction heating. An important aspect of this invention resides in the fact that the magnetic field is substantially transverse throughout the region occupied by the heated portion of the load and the flux concentrator.

Flux concentrator member 5 shown in the drawings is a solid block of magnetic material. The block is sufficiently wide and located close enough to the heated region of the load to maximize the flux concentration effect in this region without overheating the block. This member 5 is preferably fabricated from ferrite material having low loss at the operating frequency of the induction heating. The ferrite material is selected to minimize both hysteresis losses and ohmic losses from induced eddy currents. Flux concentrator member 5 is preferably movable with respect to the side entry coil. In particular, coil 1 may be raised or lowered to allow the load to be inserted laterally into the coil. The coil is then lowered so that flux concentrator member 5 is in position within the opening of the coil, as shown in the drawings, for the induction heating process. After the heating process is completed, coil 1 is raised from flux concentrator member 5 to allow the load to be removed from within the coil.

The precise parameters of the heating structure depend on the desired mode of operation. The side entry coil is preferably fabricated from solid copper or copper tubing, with or without coolant flowing through the tubing to dissipate the heat generated in the copper itself. Induction heaters suitable for this invention may be typically operated up to frequencies of approximately 8 MHz. For these highest frequencies, nickel-zinc ferrite is a preferred material in that it displays high permeability and low loss. The precise geometry of the side entry coil depends partly on the size of the load to be heated. While the coil illustrated in FIGS. 1 and 3 has straight sections of tubing along the base and sides of a "U-shape", in some instances the structure may operate more efficiently if the coil forms some other side entry configuration.

The following examples illustrate the practice of this invention.

EXAMPLE 1

In the first example, the foregoing device was used to heat-seal wire bundles or cables containing 90 wires, each wire being 20-gauge with thin walled PVC insulation. These wires were enclosed in adhesive profiles comprised of loaded polymeric sealant material, as described in U.S. Pat. No. 5,378,879, referred to above, and the entire assembly was encased in heat shrinkable tubing having a diameter of approximately 2.5 inches. The heat shrinkable tubing was also fabricated of material described in U.S. Pat. No. 5,378,879. Two 36-gauge thermocouples were embedded in the assembly on opposite sides of the cable, and the assembly was placed in the channel of a coil as illustrated in FIG. 3. The thermocouples were attached to wires located at the top and bottom of the cable, indicated as locations A and B in the orientation shown in this Figure. The channel coil was driven by a power supply at 4.5 MHz, generating an rf current of 100 amperes when the coil is unloaded. Still referring to FIG. 3 and also FIG. 2, the flux concentrator was a ferrite block having a length L of 2.00 inches, a width W of 1.00 inch, and a height H of 1.4 inches. The upper surface of flux concentrator member 5 was located a distance D1 of ¾ inches inside the coil opening, and a distance D2 of ⅜ inches below the bottom of the cable. The block material was a nickel-zinc ferrite designated as "Type 43 Material" according to the manufacturer, Fair-Rite Products Corporation of Wallkill, N.Y.

In the foregoing configuration, two identical wire bundle samples were heated inductively for 15 seconds, one sample with the flux concentrator present and the other without the flux concentrator. The temperatures at the thermocouple locations A and B were measured for each sample. For the sample heated without the flux concentrator, the temperature at the upper location A reached 190 degrees Centigrade, while the temperature at the lower location B attained 105 degrees Centigrade. For the sample heated with the flux concentrator present, the upper location A reached a temperature of 190 degrees Centigrade as before, while the temperature at location B was measured at 195 degrees Centigrade. Thus, the insertion of the flux concentrator reduced the magnitude of the temperature difference across the cable from 85 degrees to 5 degrees Centigrade, producing a dramatic increase in the uniformity of the inductive heating.

EXAMPLE 2

The second example demonstrates the improvement in efficiency of the present invention for heating 50-wire bundle samples of 18-gauge wire in thick-walled cross-linked polyethylene insulation, enclosed in adhesive sealant material, as described in U.S. Pat. No. 5,378,879. These bundles were encased in heat shrinkable tubing, also as described in U.S. Pat. No. 5,378,879 of approximately 2.00 inches and inserted in the channel coil in the same configuration as described above in Example 1. A plurality of identical samples were heated in the device over a range of heating times up to 35 seconds. One set of samples was heated with the flux concentrator present, and a second set of samples was similarly heated without the flux concentrator. Each sample was then tested for sealing.

It was found that when the flux concentrator was absent, the heat treatment would produce sealing in the cables after 26 seconds, and adhesive lumps formed in the bottom of the cables would dissolve after 30 seconds. For the samples treated with the flux concentrator present, sealing was obtained after 16 seconds, and the adhesive lump dissolved after 20 seconds. In short, the flux concentrator reduces the treatment time by a factor of approximately one-third.

The foregoing description of preferred embodiments of the invention and the particular examples set forth have been presented solely for purposes of illustration and description. They are not intended to be exhaustive or to limit the invention to the precise forms disclosed, and many modifications and variations are possible in light of the above teaching. The embodiments are chosen and described in order to best explain the principles of the invention and its practical applications to thereby enable others skilled in the art to best utilize the invention in various embodiments and with various modifications as are suitable to the particular use contemplated. Generally, this device may be used for induction heat treatment of components having low thermal conductivity, particularly where uniformity and control of the heating are required. When the induction heating element is a side entry coil, the device is especially useful for parts having a longitudinal "cable-like" configuration, where lateral access to the heating coil is required. Adhesive sleeves, and molded or plastic parts having an elongated structure are examples. It is intended that the spirit and scope of the invention are to be defined by reference to the following claims.

What is claimed is:

1. An induction heating apparatus, for heating a portion of a load containing a thermally responsive material, said induction heating apparatus comprising:

a coil including an opening such that the load may be inserted laterally into said opening with the portion of the load to be heated disposed within an area formed by said coil;

said coil generating a magnetic field when driven by an electric current through said coil, wherein the direction of the magnetic field is substantially transverse to the axis of the opening in a region surrounding and extending outwardly from at least a portion of the portion of the load to be heated;

a flux concentrator member movable between a heating position disposed along said opening and located in said region where said magnetic field is substantially transverse to the axis of the opening and a loading position removed from the opening of the coil, said flux concentrator member having a high magnetic permeability so as to thereby enhance the uniformity of the magnetic field generated within said coil; and power supply means connected to said coil for driving alternating current through said coil, such that induction heating of the portion of the load to be heated is produced by the magnetic field generated by the current.

2. The heating apparatus as recited in claim 1, wherein said flux concentrator member is comprised of ferrite material.

3. The heating apparatus as recited in claim 2, wherein said ferrite material is comprised of nickel-zinc ferrite.

4. The heating apparatus as recited in claim 1, wherein said coil comprises a U-shaped channel coil.

5. The heating apparatus as recited in claim 1, wherein the load comprises an elongated portion of a structure to be heated.

6. The heating apparatus as recited in claim 1, wherein said coil may be raised or lowered.

7. The heating apparatus as recited in claim 1, wherein said flux concentrator material has low loss at the frequency of said magnetic induction field.

8. The heating apparatus as recited in claim 1, wherein said flux concentrator member enhances the uniformity of the magnetic field generated by said coil inside the load.

9. The heating apparatus as recited in claim 1, wherein said flux concentrator member enhances the magnitude of the magnetic field generated by said magnetic field generating means inside the load.

10. A method for heating a load by magnetic induction, said method comprising the steps of:

providing a coil including an opening such that the load may be inserted laterally into the opening with the portion of the load to be heated disposed within an area formed by said coil;

inserting the portion of the load to be heated into said area through said opening;

positioning a flux concentrator member along the opening, said flux concentrator member being comprised of material having a high magnetic permeability;

generating a magnetic induction field with said coil in the load and said flux concentrator member, whereby the load is heated by said magnetic field, said magnetic field being described by magnetic flux lines such that the flux lines in said flux concentrator member primarily pass through the load, at least a portion of said magnetic flux lines being substantially transverse to said coil opening; and connecting power supply means to said coil, said power supply means generating an alternating electric current in said coil, thereby producing said magnetic field.

11. The method as recited in claim 10, wherein said flux concentrator member is comprised of ferrite material.

12. The method as recited in claim 11, wherein said ferrite material is comprised of nickel-zinc ferrite.

13. The method as recited in claim 10, wherein the step of providing a coil comprises providing a U-shaped channel coil having a base and two sides forming said opening.

14. The method as recited in claim 10, wherein the step of inserting the portion of the load comprises an elongated portion of a structure to be heated.

15. The method as recited in claim 14, wherein said coil and said flux concentrator member are movable relative to each other, such that said coil may be raised or lowered so that said flux concentrator member is positioned within said coil opening, further comprising the steps of:

prior to the step of inserting the portion of the load, raising said coil from said flux concentrator member; and following the step of inserting the portion of the load to be heated near said coil, lowering said coil.

16. The method as recited in claim 10, wherein said coil and said flux concentrator member are movable relative to each other.

17. The method as recited in claim 10, wherein said flux concentrator material has low loss at the frequency of said magnetic induction field.

18. The method as recited in claim 10, wherein said flux concentrator member enhances the uniformity of the magnetic field generated by said coil inside the load.

19. The method as recited in claim 10, wherein said flux concentrator member enhances the magnitude of the magnetic field generated by said coil inside the load.

* * * * *